US007940256B2

(12) United States Patent
Takahashi

(10) Patent No.: US 7,940,256 B2
(45) Date of Patent: May 10, 2011

(54) LIQUID CRYSTAL DISPLAY DRIVER INCLUDING A VOLTAGE SELECTION CIRCUIT HAVING OPTIMALLY SIZED TRANSISTORS, AND A LIQUID CRYSTAL DISPLAY APPARATUS USING THE LIQUID CRYSTAL DISPLAY DRIVER

(75) Inventor: Yukio Takahashi, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 1187 days.

(21) Appl. No.: 11/554,347

(22) Filed: Oct. 30, 2006

(65) Prior Publication Data

US 2007/0097060 A1 May 3, 2007

(30) Foreign Application Priority Data

Oct. 31, 2005 (JP) ..... 2005-315616

(51) Int. Cl.
*G09G 5/00* (2006.01)

(52) U.S. Cl. ..... 345/204

(58) Field of Classification Search ..... 345/87–100, 345/204, 690; 257/59, 72, 83, 257, 290, 257/351, 368, 392
See application file for complete search history.

(56) References Cited

U.S. PATENT DOCUMENTS 4,528,480 A * 7/1985 Unagami et al. ..... 315/169.1
6,831,620 B1 * 12/2004 Nishikubo et al. ..... 345/87
2002/0042177 A1 * 4/2002 Imai ..... 438/231
2003/0011024 A1 * 1/2003 Nishioka ..... 257/315
2005/0263795 A1 * 12/2005 Choi et al. ..... 257/213

FOREIGN PATENT DOCUMENTS

JP 8-279564 A 10/1996
JP 2001-36407 A 2/2001

OTHER PUBLICATIONS

Japanese Office Action, dated Feb. 1, 2011, issued in Application No. 2005-315616.

* cited by examiner

*Primary Examiner* — Sumati Lefkowitz
*Assistant Examiner* — Rodney Amadiz
(74) *Attorney, Agent, or Firm* — Sughrue Mion, PLLC

(57) ABSTRACT

A liquid crystal display driver includes a first selecting circuit configured to select a voltage from a first voltage range based on a digital signal; and a second selecting circuit configured to select a voltage from a second voltage range based on the digital signal. A voltage which is applied between a diffusion layer and a back gate of a first MOS transistor contained in the first selecting circuit is smaller than a voltage which is applied between a diffusion layer and a back gate of a second MOS transistor contained in the second selecting circuit. Also, an offset length of the first MOS transistor is shorter than that of the second MOS transistor. The liquid crystal display driver may further include a voltage generating circuit configured to supply gradation voltages of the first voltage range and the second voltage range to the first and second selecting circuits. One of the first and second selecting circuits outputs one of the gradation voltages based on the digital signal.

18 Claims, 12 Drawing Sheets

LIQUID CRYSTAL DISPLAY DRIVER INCLUDING A VOLTAGE SELECTION CIRCUIT HAVING OPTIMALLY SIZED TRANSISTORS, AND A LIQUID CRYSTAL DISPLAY APPARATUS USING THE LIQUID CRYSTAL DISPLAY DRIVER

BACKGROUND OF THE INVENTION

1. Field of the Invention

The present invention relates to a voltage selecting circuit for outputting a voltage corresponding to an input digital signal.

2. Description of the Related Art

In recent years, a liquid crystal television and a liquid crystal PC monitor have been rapidly spread. Also, in association with a higher function of a portable phone, the need for a liquid crystal display panel of a large scale and a high definition has been expanded. Under such background, the market of a driver for driving a liquid crystal display panel has been sharply grown, and the drop in the manufacturing cost of the liquid crystal display driver is desired more and more.

A digital/analog (D/A) converting circuit is built in the liquid crystal display driver. This D/A converting circuit is the circuit for converting an image data of a digital format into an analog gradation voltage that is applied to a pixel. Thus, this D/A converting circuit can be referred to as [Gradation Voltage Determining Circuit] for determining a gradation voltage corresponding to the image data.

FIG. 1 shows the configuration of a typical gradation voltage determining circuit 50. For example, this gradation voltage determining circuit 50 can output 64 gradation output voltages (gradation voltages) V0 to V63 based on a 6-bit digital image signal D0 to D5. Specifically, the gradation voltage determining circuit 50 has a gradation voltage generating circuit 51 and a gradation voltage selecting circuit 52. Reference voltages Vref0 to Vref9 are supplied to the gradation voltage generating circuit 51 from an external power source. This gradation voltage generating circuit 51 has a resistor array composed of 64 resistors R1 to R64. The input reference voltages Vref0 to Vref9 are suitably divided by the resistor array. Consequently, the gradation voltages V0 to V63 of 64 stages are generated.

On the other hand, the gradation voltage selecting circuit 52 receives the digital image signals D0 to D5 and the gradation voltages V0 to V63 and selects one gradation voltage from among the gradation voltages V0 to V63 based on the digital image signal. In short, the gradation voltage selecting circuit 52 carries out the role for decoding the digital image signal D0 to D5. Typically, a breakdown voltage of 12 to 18 volts or more is required for the liquid crystal display driver. The gradation voltage selecting circuit 52 serving as a decoder is composed of a large number of high breakdown voltage MOS transistors which have the matrix-shaped layout. One gradation voltage selected by the gradation voltage selecting circuit 52 is outputted from an output terminal OUT and applied to the pixel.

FIG. 2 shows an ideal relation (referred to as [V-T Characteristic]) between output voltage (gradation voltage) V and light transmittance T of a liquid crystal. As shown in FIG. 2, the ideal V-T characteristic is represented by a non-linear curve. By adjusting the reference voltages Vref0 to Vref9 supplied to the gradation voltage generating circuit 51, it is possible to compensate the output voltage and make the V-T characteristic approximate to the ideal shape.

As the conventional technique related to the liquid crystal display driver, a reference voltage switching circuit is disclosed in Japanese Laid Open Patent Application (JP-P2001-36407A). This reference voltage switching circuit has a digital data voltage decoding circuit corresponding to the gradation voltage selecting circuit 52. The decoding circuit is divided into a plurality of blocks 52-1 to 52-I, as shown in FIG. 1. Then, a well voltage of the MOS transistor included in each block is set to be different for each block. That is, a voltage applied to a back gate of the MOS transistor is different for each block.

Also, Japanese Laid Open Patent Application (JP-A-Heisei, 8-279564) discloses a voltage selector circuit corresponding to the gradation voltage selecting circuit 52. The voltage selector circuit is provided with a plurality of MIS transistors for outputting selection voltages, and is also divided into a plurality of blocks as shown in FIG. 1. Then, a channel length of the MIS transistor is designed to be different for each block. Specifically, the channel length of the MIS transistor to which a substrate bias effect is applied by selecting the middle selection voltage is designed to be shorter than the channel length of the MIS transistor to which the substrate bias effect is not applied by selecting the highest or lowest selection voltage.

This inventor paid attention to the following points. That is, a large number of high breakdown voltage MOS transistors that have an offset gate structure are used in the gradation voltage selecting circuit 52 shown in FIG. 1. The size of the high breakdown voltage MOS transistor is large, and the area of the gradation voltage selecting circuit 52 that requires the large number of high breakdown voltage MOS transistors becomes very large. This fact leads to the increase in the cost of the liquid crystal display driver. In particular, in the liquid crystal display for TV, the liquid crystal display driver that can display 1,000,000,000 colors is required in order to attain a larger scale screen size and the higher image quality display. For this reason, the gradation voltage selecting circuit 52 that can treat the output voltage of 1024 gradations (10 bits) is required. Thus, the increase in the circuit area caused by the increase in the number of elements becomes more severe. This results in the further increase in the cost of the liquid crystal display driver.

SUMMARY OF THE INVENTION

In an aspect of the present invention, a liquid crystal display driver includes a first selecting circuit configured to select a voltage from a first voltage range based on a digital signal; and a second selecting circuit configured to select a voltage from a second voltage range based on the digital signal. A voltage which is applied between a diffusion layer and a back gate of a first MOS transistor contained in the first selecting circuit is smaller than a voltage which is applied between a diffusion layer and a back gate of a second MOS transistor contained in the second selecting circuit. Also, an offset length of the first MOS transistor is shorter than that of the second MOS transistor.

Here, the liquid crystal display driver may further include a voltage generating circuit configured to supply gradation voltages of the first voltage range and the second voltage range to the first and second selecting circuits. One of the first and second selecting circuits outputs one of the gradation voltages based on the digital signal.

Also, a same voltage may be applied to the back gate of the first MOS transistor and the back gate of the second MOS transistor, and a difference between the first voltage range and between the same voltage may be smaller than a difference between the second voltage range and the same voltage.

Also, a gate length of the second MOS transistor may be shorter than that of the first MOS transistor.

Also, a gate width of the first MOS transistor may be smaller than that of the second MOS transistor.

Also, each of the first MOS transistor and the second MOS transistor may include a low concentration diffusion layer for a drift region; and a contact diffusion layer used to apply a fixed voltage to the back gate. The shortest distance between the low concentration diffusion layer and the contact diffusion layer in the first MOS transistor may be shorter than the shortest distance between the low concentration diffusion layer and the contact diffusion layer in the second MOS transistor.

Also, a power supply voltage may be applied to the back gate of the first MOS transistor and the back gate of the second MOS transistor. The voltage of the first voltage range may be smaller than the power supply voltage, and the voltage of the second voltage range may be smaller than the voltage of the first voltage range.

In this case, each of the first selecting circuit and the second selecting circuit may include a terminal to which a corresponding one of the first voltage range and the second voltage range is supplied; and a first stage MOS transistor that one of the source/drain is connected with the terminal. The power supply voltage may be applied to the back gate of the first stage MOS transistor, and the offset length of one of the source and the drain which is connected with the terminal may be longer than that of the other in the first stage MOS transistor.

Also, the offset lengths on the other side in the first selecting circuit and the second selecting circuit may be equal to the offset length of the first MOS transistor and the offset length of the second MOS transistor, respectively.

In another aspect of the present invention, a liquid crystal display driver includes a first selecting circuit configured to select a voltage from a first voltage range based on a digital signal; and a second selecting circuit configured to select a voltage from a second voltage range based on the digital signal. A voltage which is applied between a diffusion layer and a back gate of a first MOS transistor in the first selecting circuit is smaller than a voltage which is applied between a diffusion layer and a back gate of a second MOS transistor in the second selecting circuit, and a gate width of the first MOS transistor is smaller than a gate width of the second MOS transistor.

Here, the liquid crystal display driver may further include a voltage generating circuit configured to supply gradation voltages of the first voltage range and the second voltage range to the first and second selecting circuits. One of the first and second selecting circuits may output one of the gradation voltages based on the digital signal.

Also, in the first MOS transistor, a narrow channel effect appears.

In another aspect of the present invention, a liquid crystal display driver include a first selecting circuit configured to select a voltage from a first voltage range based on a digital signal; and a second selecting circuit configured to select a voltage from a second voltage range based on the digital signal. A voltage which is applied between a diffusion layer and a back gate of the first MOS transistor in the first selecting circuit is smaller than a voltage which is applied between a diffusion layer and a back gate of a second MOS transistor in the second selecting circuit. Each of the first MOS transistor and the second MOS transistor includes a low concentration diffusion layer for a drift region; and a contact diffusion layer configured to apply a fixed voltage to the back gate, and the shortest distance between the low concentration diffusion layer and the contact diffusion layer in the first MOS transistor is shorter than the shortest distance between the low concentration diffusion layer and the contact diffusion layer in the second MOS transistor.

Also, the liquid crystal display driver may further include a voltage generating circuit configured to supply gradation voltages of the first voltage range and the second voltage range to the first and second selecting circuits. One of the first and second selecting circuits may output one of the gradation voltages based on the digital signal.

Also, the liquid crystal display driver may further include a third selecting circuit configured to select a voltage from a third voltage range based on the digital signal; and a fourth selecting circuit configured to select a voltage from a fourth voltage range based on the digital signal. A voltage which is applied between a diffusion layer and a back gate of a third MOS transistor in the third selecting circuit is smaller than a voltage which is applied between a diffusion layer and a back gate of a fourth MOS transistor in the fourth selecting circuit, and an offset length of the third MOS transistor is shorter than that of the fourth MOS transistor.

Here, the first MOS transistor and the second MOS transistor may be P-channel MOS transistors, and the third MOS transistor and the fourth MOS transistor may be N-channel MOS transistors.

Also, the voltage of the first voltage range and the voltage of the second voltage range may be larger than a predetermined common voltage. The voltage of the third voltage range and the voltage of the fourth voltage range may be smaller than the predetermined common voltage.

In another aspect of the present invention, a liquid crystal display apparatus includes a liquid crystal display driver; and a liquid crystal display panel which has a plurality of pixels. The liquid crystal display driver includes a first selecting circuit configured to select a voltage from a first voltage range based on a digital signal; a second selecting circuit configured to select a voltage from a second voltage range based on the digital signal; and a voltage generating circuit configured to supply gradation voltages of the first voltage range and the second voltage range to the first and second selecting circuits. One of the first and second selecting circuits outputs one of the gradation voltages based on the digital signal, and the liquid crystal display driver applies the gradation voltage to either of the plurality of pixels. A voltage which is applied between a diffusion layer and a back gate of a first MOS transistor contained in the first selecting circuit is smaller than a voltage which is applied between a diffusion layer and a back gate of a second MOS transistor contained in the second selecting circuit, and an offset length of the first MOS transistor is shorter than that of the second MOS transistor.

DESCRIPTION OF THE PREFERRED EMBODIMENTS

Hereinafter, a voltage selecting circuit according to an embodiment of the present invention will be described in detail with reference to the attached drawings. The voltage selecting circuit is a gradation voltage selecting circuit used in a liquid crystal displaying apparatus.

Figure 3:
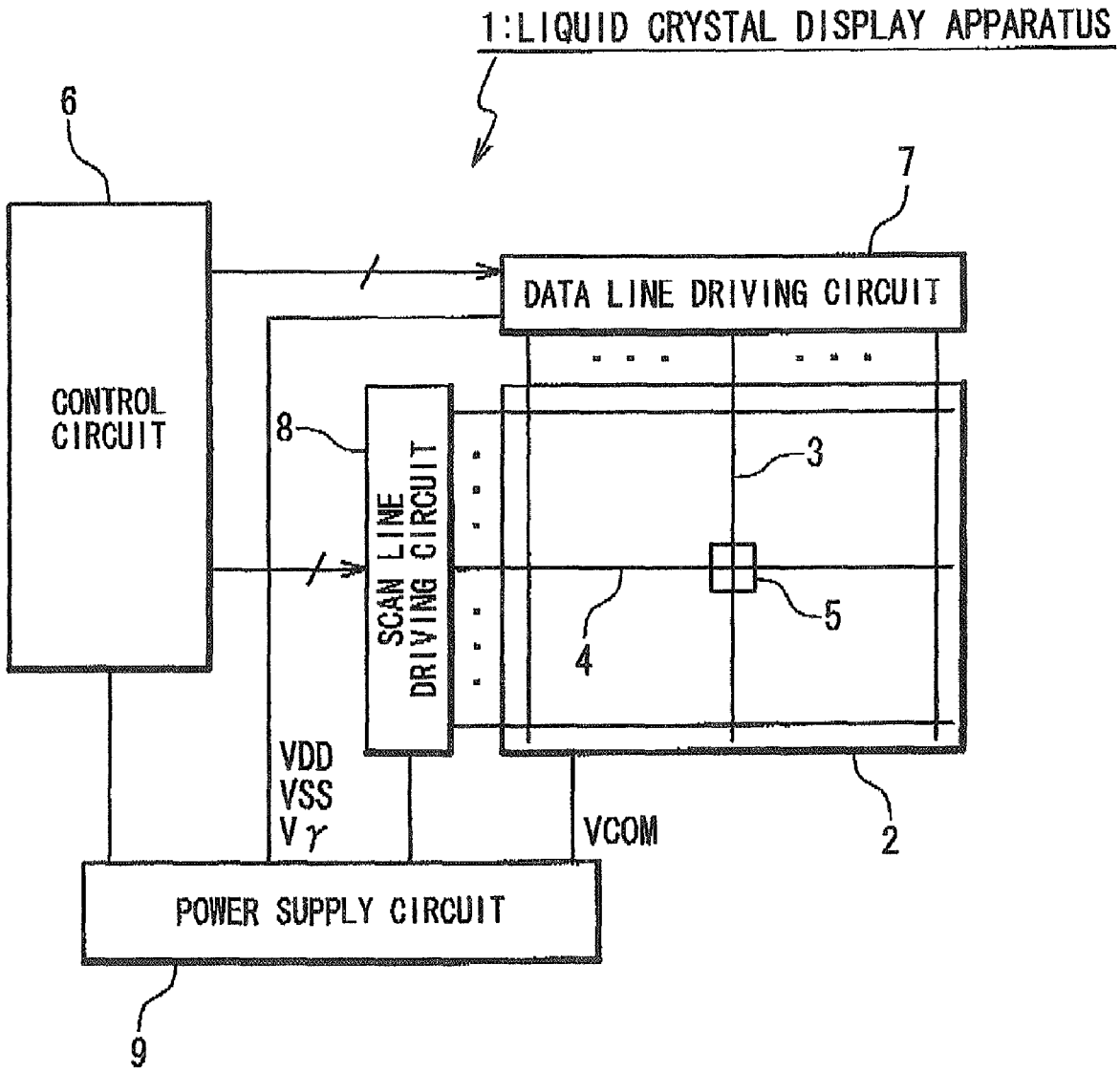
FIG. 3 is a block diagram showing a configuration of a liquid crystal displaying apparatus according to an embodiment of the present invention.

FIG. 3 is a block diagram showing a configuration of a liquid crystal displaying apparatus 1 according to an embodiment of the present invention. The liquid crystal displaying apparatus 1 is provided with a liquid crystal display panel 2 having a plurality of pixels 5 arranged in a matrix. On the liquid crystal display panel 2, a plurality of data lines 3 and a plurality of scanning lines 4 are formed to intersect each other, and the pixel 5 is formed at each intersection. The pixel 5 has a TFT (Thin Film Transistor), a liquid crystal and a common electrode. A gate terminal of the TFT is connected to the scanning line 4, and a source terminal or drain terminal of the TFT is connected to the data line 3. One end of the liquid crystal is connected to the source terminal or drain terminal of the TFT. The other end thereof is connected to the common electrode to which a certain common voltage VCOM is applied.

Also, the liquid crystal displaying apparatus 1 contains a control circuit 6, a data line driving circuit 7 and a scanning line driving circuit 8. The data line driving circuit 7 is the driver (source driver) for driving the plurality of data lines 3. The scanning line driving circuit 8 is a driver (gate driver) for driving the plurality of scanning lines 4. The control circuit 6 outputs a scanning line control signal to the scanning line driving circuit 8 and outputs a data line control signal and a digital image signal based on an image to be displayed, to the data line driving circuit 7. The scanning line driving circuit 8 drives the plurality of scanning lines 4 in accordance with the scanning line control signal. Also, the data line driving circuit 7 outputs an analog gradation voltage based on the digital image signal to the plurality of data lines 3 in accordance with the data line control signal. Consequently, the gradation voltage (pixel voltage) based on the image is applied to each of the plurality of pixels 5 linked to the selected one scanning line 4. Since the plurality of scanning lines 4 are driven sequentially, the image is displayed on the liquid crystal display panel 2.

Moreover, the liquid crystal displaying apparatus 1 is provided with a power source circuit 9. The power source circuit 9 supplies a predetermined voltage to each circuit. For example, the power source circuit 9 supplies a first voltage VDD, a second voltage VSS and a reference voltage Vγ and the like, which will be described later, to the data line driving circuit 7. Also, the power source circuit 9 supplies the common voltage VCOM to a common electrode of the pixel 5.

Figure 4:
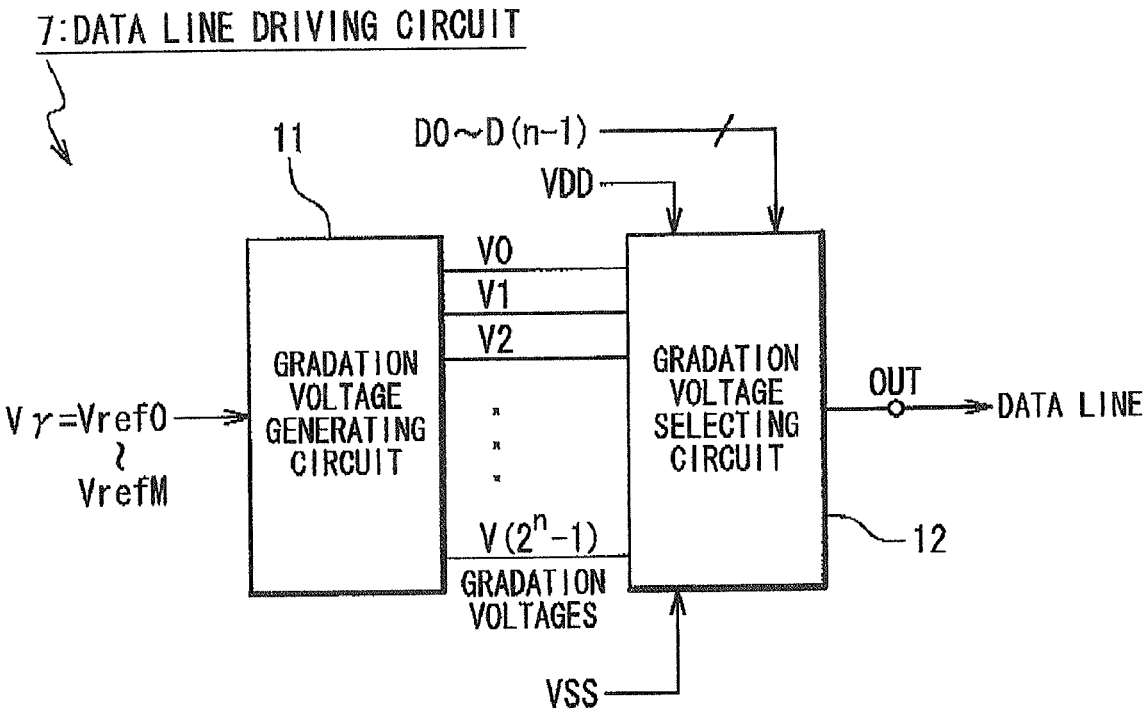
FIG. 4 is a block diagram showing a configuration of a data line driving circuit according to an embodiment of the present invention.

FIG. 4 is a block diagram showing the configuration of the data line driving circuit 7. The data line driving circuit 7 can receive digital image signals D0 to D(n−1) of n bits and output $2^n$ kinds of output voltages V0 to V($2^n$−1) according to the image signals. For example, the data line driving circuit 7 can output the output voltages (gradation voltages) V0 to V63 of 64 gradations in accordance with the digital image signals D0 to D5 of 6 bits.

Specifically, the data line driving circuit 7 is provided with a gradation voltage generating circuit 11 and a gradation voltage selecting circuit 12. The reference voltage Vγ is supplied from the power source circuit 9 to the gradation voltage generating circuit 11. The reference voltage Vγ may include a plurality of reference voltages Vref0 to VrefM. The gradation voltage generating circuit 11 generates the gradation voltages V0 to V($2^n$−1) in accordance with the reference voltage Vγ and supplies them to the gradation voltage selecting circuit 12. The gradation voltage selecting circuit 12 receives the digital image signals D0 to D(n−1) together with the gradation voltages V0 to V($2^n$−1). Then, the gradation voltage selecting circuit 12 selects one of the gradation voltages V0 to V($2^n$−1) based on the received digital image signals D0 to D(n−1). In short, the gradation voltage selecting circuit 12 is a decoder for decoding the digital image signals D0 to D(n−1), and this is also a D/A converting circuit in the data line driving circuit 7. The selected one gradation voltage is outputted from an output terminal OUT and applied to one of the pixels 5.

The gradation voltage generating circuit 11 and the gradation voltage selecting circuit 12 according to the present invention will be described below in detail. As an example, a case will be described in which the number of the bits in the digital image signal is 6 and the displaying of 64 gradations is carried out. Also, there is a case that the gradation voltage generating circuit 11 and the gradation voltage selecting circuit 12 are integrally referred to as [Gradation Voltage Determining Circuit].

First Embodiment

Figure 5:
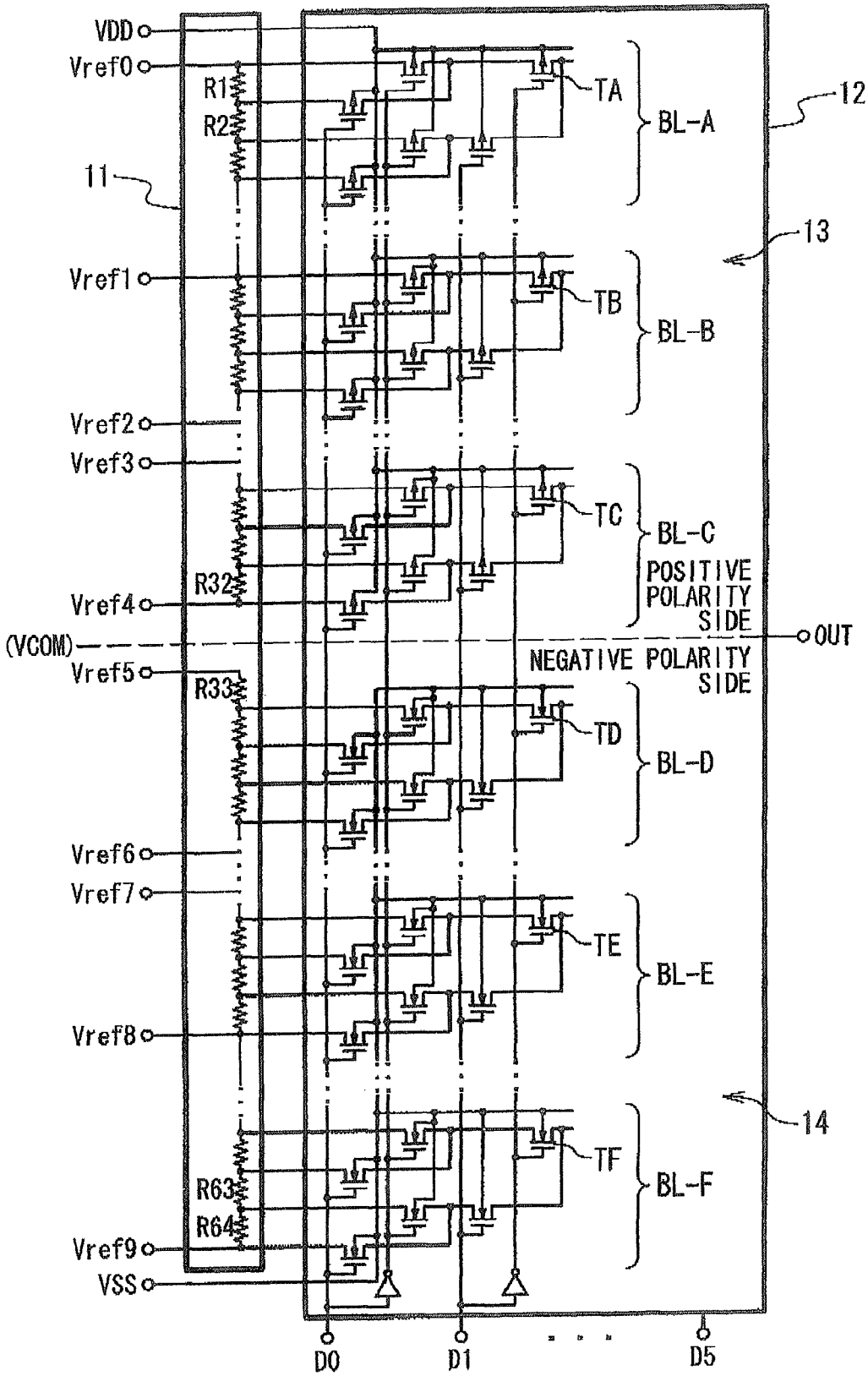
FIG. 5 is a circuit diagram showing a configuration of a gradation voltage determining circuit according to a first embodiment.

FIG. 5 is a circuit diagram showing the configuration of the gradation voltage determining circuit according to the first embodiment. As shown in FIG. 5, the gradation voltage generating circuit 11 contains a resistor array composed of 64 resistors R1 to R64 having a same resistance value. The resistors R1 to R32 are connected in series, and the reference voltages Vref0 and Vref4 are supplied from the power source circuit 9 and are applied to both ends thereof, respectively. The reference voltages Vref1 to Vref3 are applied to the proper positions in the connection points (nodes) between the resistors. Similarly, the resistors R33 to R64 are connected in series, and the reference voltages Vref5 and Vref9 supplied from the power source circuit 9 are applied to both ends thereof, respectively. The reference voltages Vref6 to Vref8 are applied to the proper positions in the connection points (nodes) between the resistors.

Figure 1:
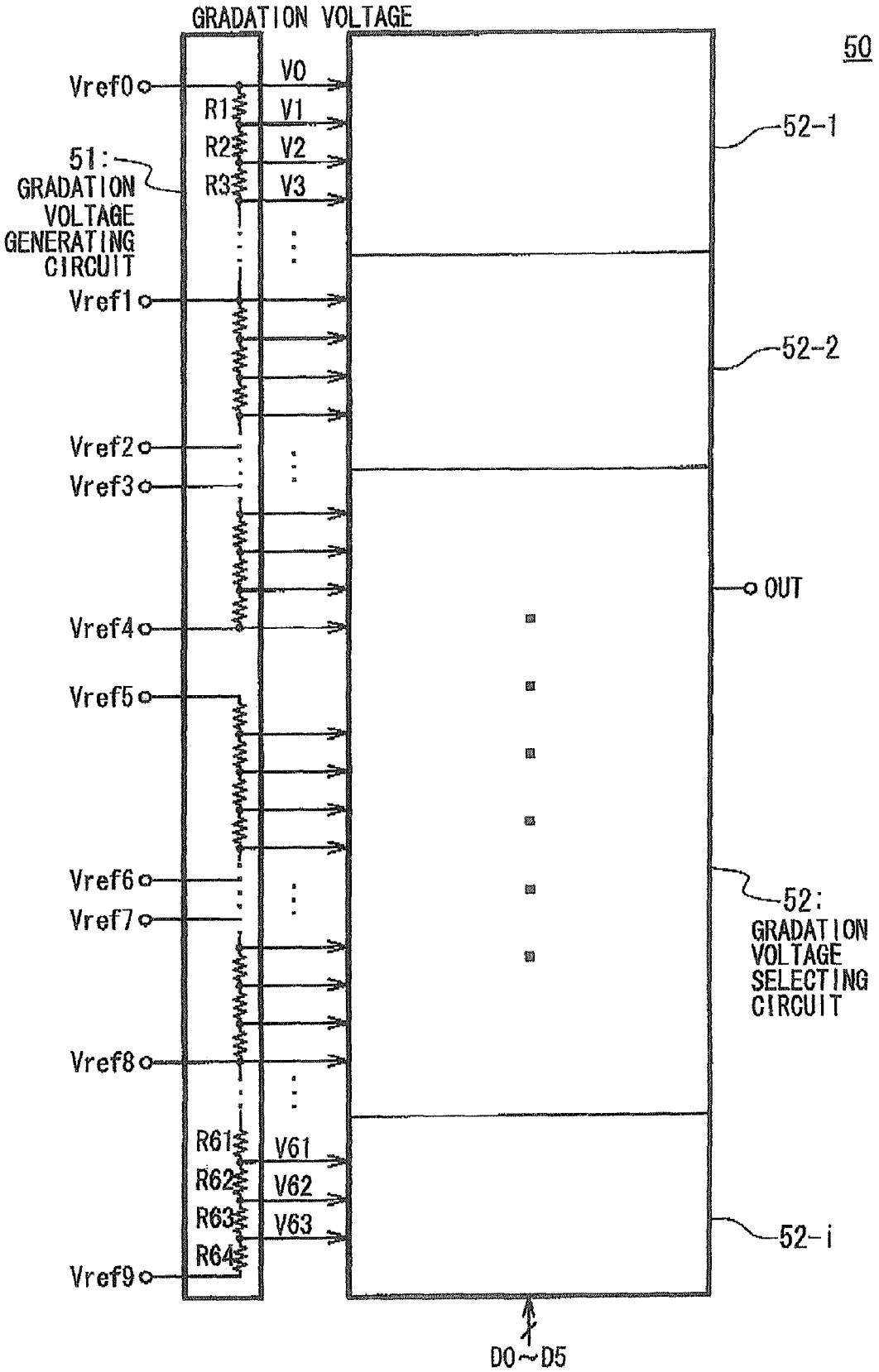
Fig. 1 PRIOR ART
FIG. 1 is a circuit block diagram showing a configuration of a conventional gradation voltage determining circuit.
Figure 2:
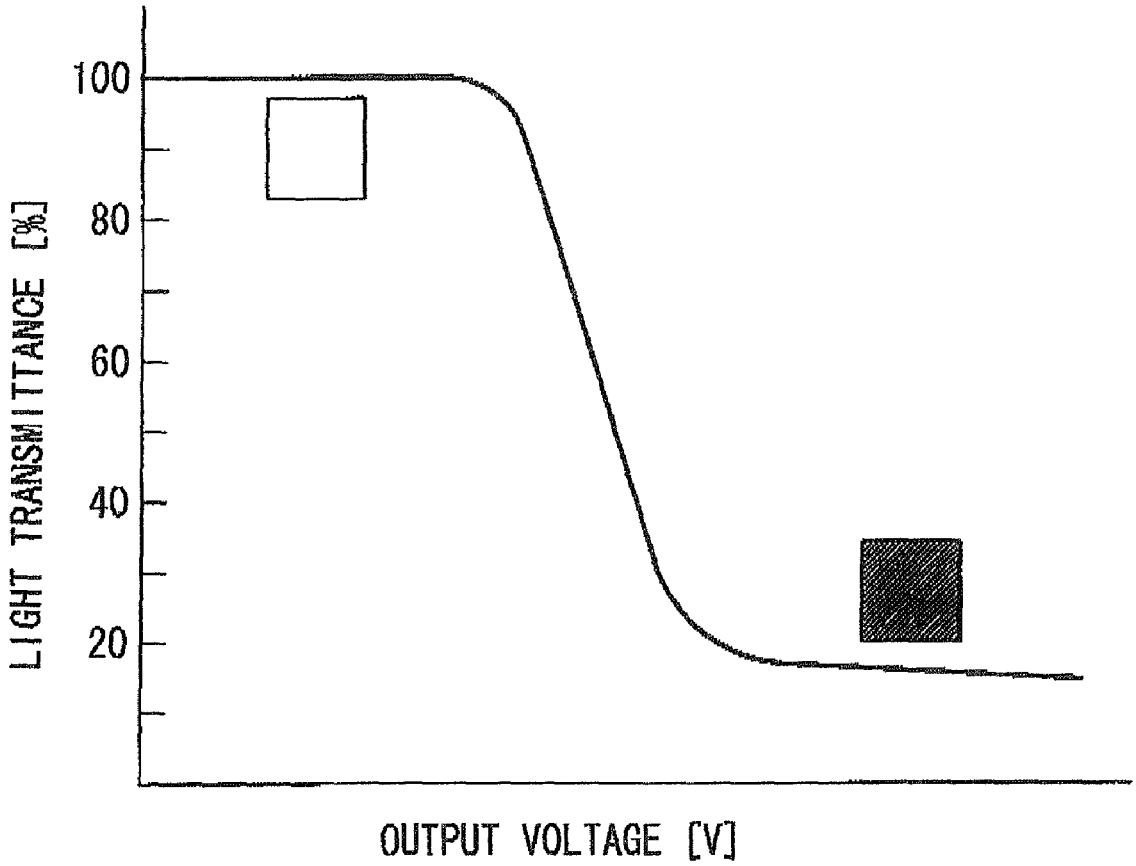
Fig. 2 PRIOR ART
FIG. 2 is a graph showing a relation between an output voltage T and a reference voltage of a liquid crystal.

Those reference voltages Vref0 to Vref9 are set to satisfy a relation of [First Voltage VDD≧Vref0>Vref1> . . . >Vref9≧Second Voltage VSS]. The portion between the reference voltages Vref0 to Vref9 is divided by the 64 resistors R1 to R64. Thus, 64 kinds of voltages are generated at the respective 64 nodes. That is, the gradation voltage generating circuit 11 can generate the gradation voltages V0 to V63 of 64 gradations in accordance with the reference voltages Vref0 to Vref9. Also, by properly adjusting those reference voltages Vref0 to Vref9, it is possible to set the gradation voltages V0 to V63 to obtain the desirable characteristic (refer to FIG. 2). The gradation voltages V0 to V63 are supplied to the gradation voltage selecting circuit 12.

The gradation voltage selecting circuit 12 is a decoder for selecting one of the gradation voltages V0 to V63 based on the digital image signals D0 to D5. For this reason, the gradation voltage selecting circuit 12 is composed of a plurality of MOS transistors connected in multiple stages as shown in FIG. 5. The source or drain of the MOS transistor of the first stage is connected to any node in the gradation voltage generating circuit 11. Also, any of the digital image signals D0 to D5 or any of inversion signals obtained through inverters is supplied to the gate of each MOS transistor. With this configuration, one gradation voltage based on the digital image signals D0 to D5 is selected. For example, in the configuration shown in FIG. 5, the 64 kinds of the gradation voltages are limited to 32 kinds by the signal D0, and the 32 kinds of the gradation voltages are limited to 16 kinds by the signal D1, and one gradation voltage is finally specified. The selected and specified one gradation voltage is outputted from the output terminal OUT.

In this embodiment, the gradation voltage selecting circuit 12 is classified into a plurality of [Selecting Circuit Blocks BL] based on the voltage range to be treated. For example, as shown in FIG. 5, a MOS transistor TA included in the block BL-A treats the voltage range between Vref0 and Vref1, and the block BL-A selects a voltage from the voltage range between Vref0 and Vref1 based on the digital image signals D0 to D5. Also, a MOS transistor TB included in the block BL-B treats the voltage range between Vref1 and Vref2, and the block BL-B selects the voltage from the voltage range between Vref1 and Vref2 based on the digital image signals D0 to D5. Similarly, the MOS transistors TC to TF included in the respective blocks BL-C to BL-F treat the voltage ranges between Vref3 and Vref4, between Vref5 and Vref6, between Vref7 and Vref8 and between Vref8 and Vref9, respectively.

Also, in the typical liquid crystal displaying apparatus, the gradation voltage having the positive and negative polarities with respect to the common voltage VCOM applied to the common electrode is often applied to the pixel 5. To that end, the common voltage VCOM may be set so as to belong, for example, between the reference voltages Vref4 and Vref5. In this case, the blocks BL-A to BL-C that treat the reference voltages Vref0 to Vref4 are said to constitute a block group 13 on [Positive Side]. On the other hand, the blocks BL-D to BL-F that handle the reference voltages Vref5 to Vref9 are said to constitute a block group 14 on [Negative Side].

The MOS transistors TA to TC included in the positive side block group 13 are the P-channel MOS transistors. On the other hand, the MOS transistors TD to TF included in the negative side block group 14 are the N-channel MOS transistors. According to this embodiment, as shown in FIG. 5, the first voltage VDD is uniformly applied to the back gates of the P-channel MOS transistors TA to TC. On the other hand, the second voltage VSS is uniformly applied to the back gates of the N-channel MOS transistors TD to TF.

Figure 6:
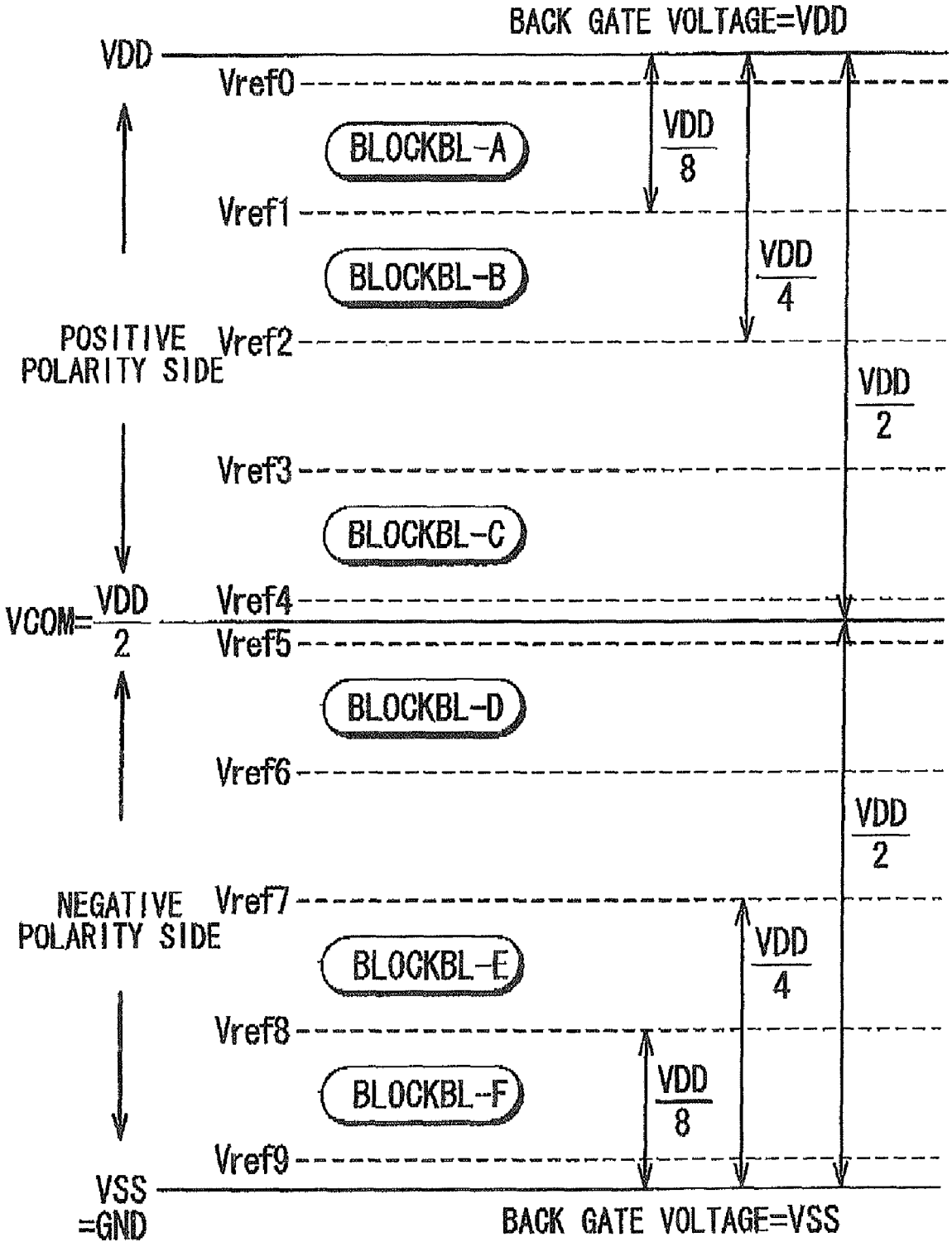
FIG. 6 is a conceptual view sowing a relation of a voltage.

The relation between the respective voltages as indicated above is summarized in FIG. 6. The reference voltages Vref0 to Vref9 are set to satisfy the relation of [First Voltage VDD≧Vref0>Vref1> . . . >Vref9≧Second Voltage VSS]. The first voltage VDD is typically the power source voltage VDD. The second voltage VSS is typically the ground voltage GND. The common voltage VCOM of the common electrode is typically VDD/2. The voltages in the voltage range between Vref0 and Vref1 are lower than the power source voltage VDD, and the voltages in the voltage range between Vref1 and Vref2 are lower than the voltages in the voltage range between Vref0 and Vref1. The voltages in the voltage range between Vref8 and Vref9 are higher than the ground voltage VSS, and the voltages in the voltage range between Vref7 and Vref8 are higher than the voltages in the voltage range between Vref8 and Vref9. The voltages in the voltage range between Vref3 and Vref4 are higher than the common voltage VCOM, and the voltages in the voltage range between Vref5 and Vref6 are lower than the common voltage VCOM.

Also, the power source voltage VDD is applied to the back gates of the P-channel MOS transistors TA to TC included in the blocks BL-A to BL-C on the positive polarity. Since the voltage ranges treated by the respective blocks at the time of the normal operation are different, "Maximum Voltage" applied between the diffusion layers (source, drain) and the back gate of the MOS transistor is different for each block. For example, if the values of the respective voltage ranges are equal, as shown in FIG. 6, the maximum voltage with regard to the block BL-A is [VDD/8]. Also, the maximum voltage with regard to the block BL-B is [VDD/4], and the maximum voltage with regard to the block BL-C is [VDD/2].

On the other hand, the ground voltage GSS is applied to the back gates of the N-channel MOS transistors TD to TF included in the blocks BL-D to BL-F on the negative polarity. Similarly, the maximum voltage with regard to the block BL-D is [VDD/2]. Also, the maximum voltage with regard to the block BL-E is [VDD/4], and the maximum voltage with regard to the block BL-F is [VDD/8].

This maximum voltage is a value corresponding to [Substrate Bias] that is applied between the substrate and the source of the MOS transistor. The gradation voltage selecting circuit 12 according to this embodiment can be said to be classified into the plurality of blocks BL in accordance with the substrate bias. Also, it is known that a threshold voltage Vt of the MOS transistor is given as a function of the substrate bias and as the substrate bias becomes greater, the threshold voltage Vt is increased. This is referred to as [Substrate Bias Effect (Back Gate Effect)]. As evident from FIG. 6, the substrate bias effect on the positive side is the greatest in the block BL-C and the smallest in the block BL-A. On the other hand, the substrate bias effect on the negative side is the greatest in the lock BL-D and the smallest in the block BL-F.

As described later, each of the MOS transistors TA to TF according to this embodiment is designed to have the optimal structure (an offset length, a gate length, a gate width and the like) and size, in accordance with the foregoing maximum voltage (substrate bias), substrate bias effect and threshold voltage and the like. The design of the optimal structure and size for each MOS transistor will be described below in detail.

Figure 7:
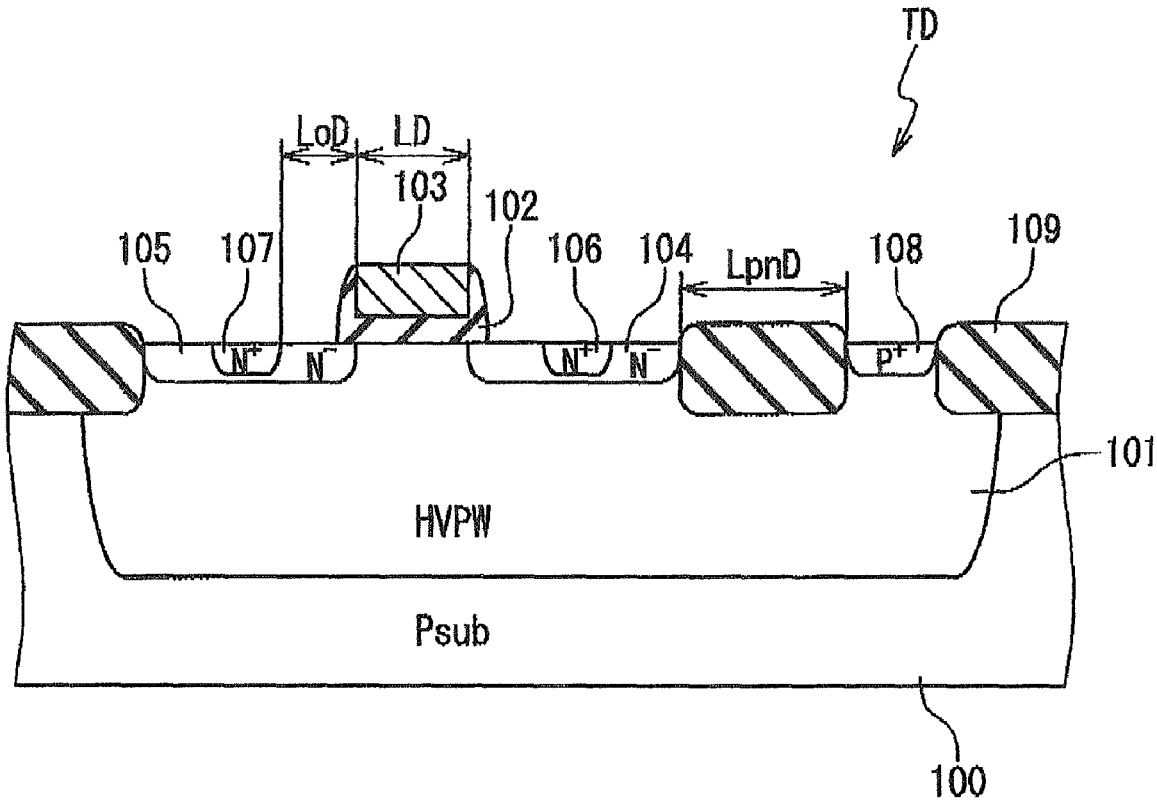
FIG. 7 is a sectional view showing a structure of a MOS transistor TD in a selecting circuit block BL-D.
Figure 8:
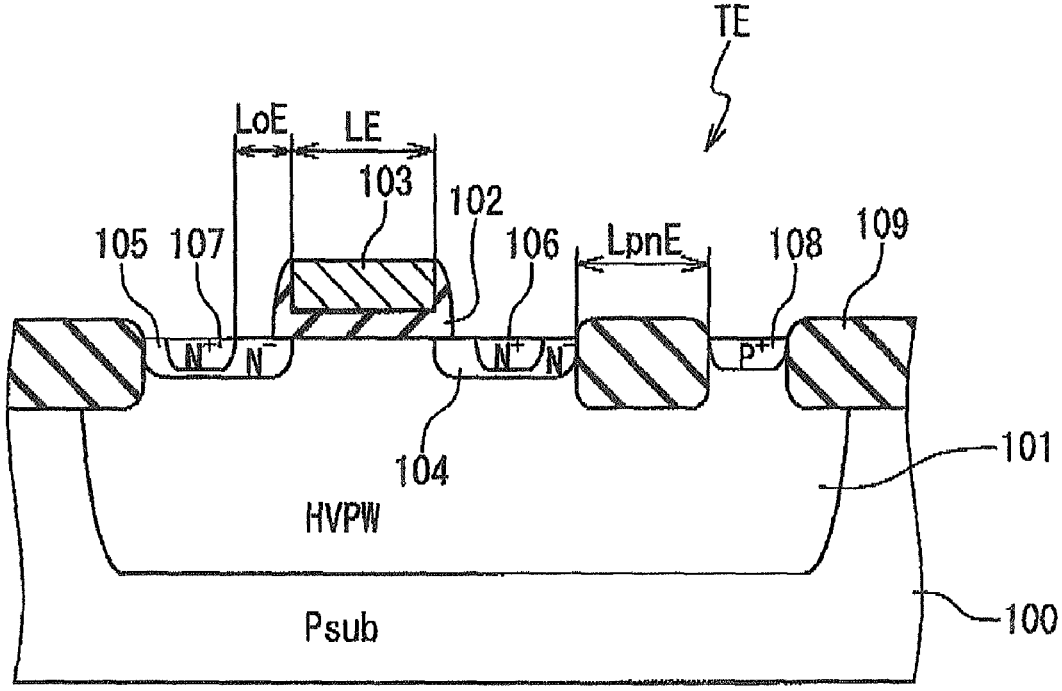
FIG. 8 is a sectional view showing a structure of a MOS transistor TE in a selecting circuit block BL-E.
Figure 9:
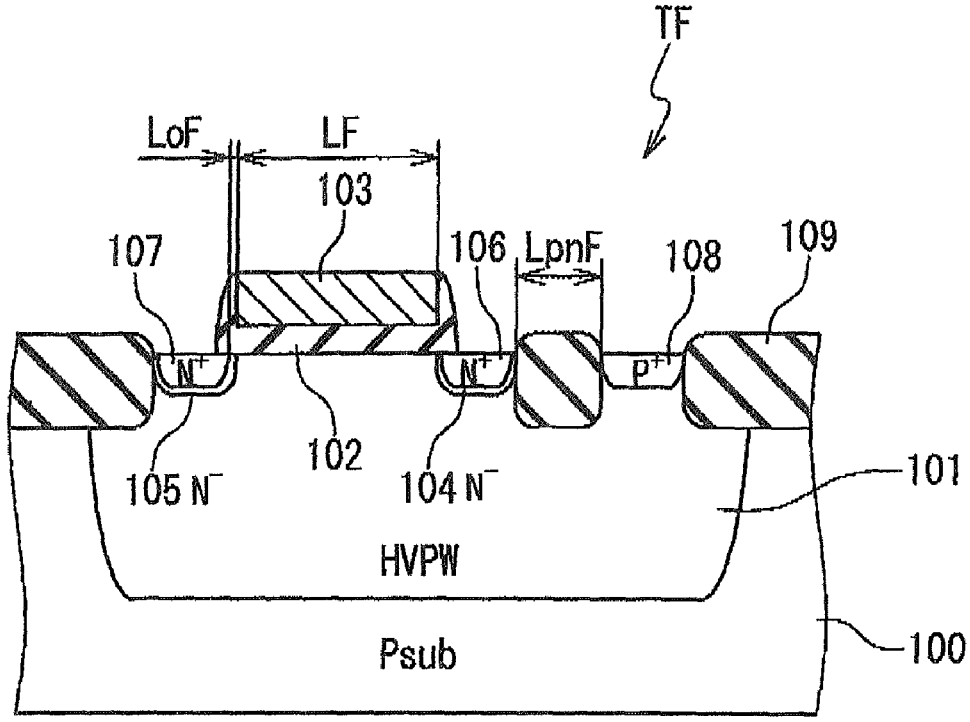
FIG. 9 is a sectional view showing a structure of a MOS transistor TF in a selecting circuit block BL-F.

FIGS. 7 to 9 show sectional structures of the N-channel MOS transistors TD to TF in the negative side block group 14, respectively. The discussion similar to the following discussion can be applied to the sectional structures of the P-channel MOS transistors TA to TC in the positive side block group 13. Thus, their description will be omitted. The N-channel MOS transistors TD to TF are formed by using a high breakdown voltage CMOS semiconductor process, and their basic configurations are similar. That is, a high voltage P well 101 is formed on the main surface side of a P-type semiconductor substrate 100. A gate electrode 103 is selectively formed through a high voltage gate oxide film 102 on the surface of the high voltage P well 101. By a known diffusion self-alignment technique that uses the gate electrode 103 as a mask, an N-type diffusion layer 104 of a low concentration and an $N^-$ type diffusion layer 105 are formed in the high voltage P well 101. Also, an $N^+$ type drain diffusion layer 106 as a drain is formed inside the $N^-$ type diffusion layer 104, and an $N^+$ type source diffusion layer 107 as a source is formed inside the $N^-$ type diffusion layer 105. Also, a back gate contact diffusion layer 108 is formed in the high voltage P well 101 to apply a back gate voltage to the high voltage P well 101. An element separation structure 109 is formed in the outer circumference regions of the $N^-$ type diffusion layers 104, 105 and back gate contact diffusion layer 108 to separate the respective N-channel MOS transistors and the back gate contact diffusion layer 108. As the element separation structure 109, a field oxide film and STI (Shallow Trench Isolation) are exemplified.

The gate electrode 103 does not overlap with the $N^+$ type drain diffusion layer 106 and the $N^+$ type source diffusion layer 107. In this way, the MOS transistor in which the gate electrode does not overlap with the source/drain is referred to as an offset gate MOS transistor. The length between the gate electrode 103 of the offset gate MOS transistor and the source or drain is referred to as [Offset Length]. An offset region having a certain offset length Lo is reserved between the gate electrode 103 and the $N^+$ type drain diffusion layer 106 or the $N^+$ type source diffusion layer 107. The $N^-$ type diffusion layer 104 and the $N^-$ type diffusion layer 105 of the low concentration constitute a drift region, which relaxes the electric field that are applied between the drain and the back gate and between the source and back gate. This relaxation in the electric field allows the higher breakdown voltage of the MOS transistor. The typical high breakdown voltage MOS transistor has such an offset gate structure.

Figure 10:
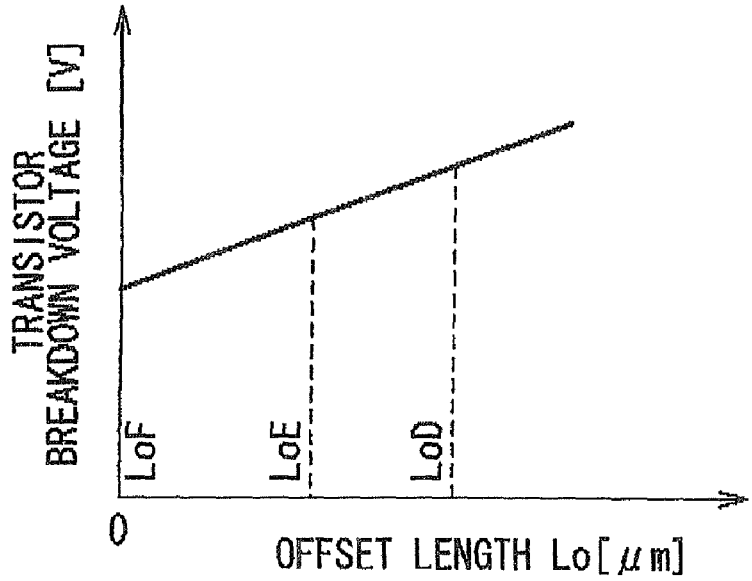
FIG. 10 is a graph showing a relation between an offset length and a breakdown voltage of a MOS transistor.

FIG. 10 shows a relation between the offset length Lo and the transistor breakdown voltage (the breakdown voltages between the drain and the back gate and between the source and the back gate). As understood from FIG. 10, there is a tendency that as the offset length Lo becomes longer, the transistor breakdown voltage becomes higher. Thus, if the MOS transistor of the high breakdown voltage is required, the offset length Lo may be designed to be longer. On the contrary, if the high breakdown voltage is not required so much, the offset length Lo can be designed to be shorter.

As mentioned above, the maximum voltage applied between the source/drain and the back gate of the N-channel MOS transistor TD included in the block BL-D is VDD/2. An offset length LoD of the N-channel MOS transistor TD is designed to have a long dimension, for example, several μm. This offset length LoD is the value equivalent to a gate length LD. Also, as shown in FIG. 7, the offset region is provided not only between the gate electrode 103 and the source/drain, but also between the source/drain and the element separation structure 109. For this reason, the offset region occupies ⅔ or more of the area of the N-channel MOS transistor TD.

The maximum voltage with regard to the N-channel MOS transistor TE included in the block BL-E is VDD/4. Thus, as understood from the comparison between FIG. 7 and FIG. 8, an offset length LoE of the N-channel MOS transistor TE can be designed to be shorter than the offset length LoD. As a result, an unusefulness portion of the N-channel MOS transistor TE is removed, thereby reducing the area of the block BL-E. It should be noted that the offset region occupies about ½ of the area of the N-channel MOS transistor TE.

The maximum voltage with regard to the N-channel MOS transistor TF included in the block BL-F is VDD/8. Thus, as understood from the comparison between FIG. 8 and FIG. 9, an offset length LoF of the N-channel MOS transistor TF can be designed to be shorter than the offset length LoE. For example, it is possible to attain the structure in which the offset length LoF becomes approximately zero. As a result, an unuseful portion of the N-channel MOS transistor TF is removed, which greatly reduces the area of the block BL-F.

As described above, according to this embodiment, the offset length Lo of the MOS transistor is designed to have the optimal value in accordance with the maximum voltage applied between the diffusion layer and the back gate. In the foregoing examples, the N-channel MOS transistors TD, TE and TF are designed to obtain the relation of [LoD>LoE>LoF]. Consequently, the size of each block BL is reduced as much as possible.

Figure 11:
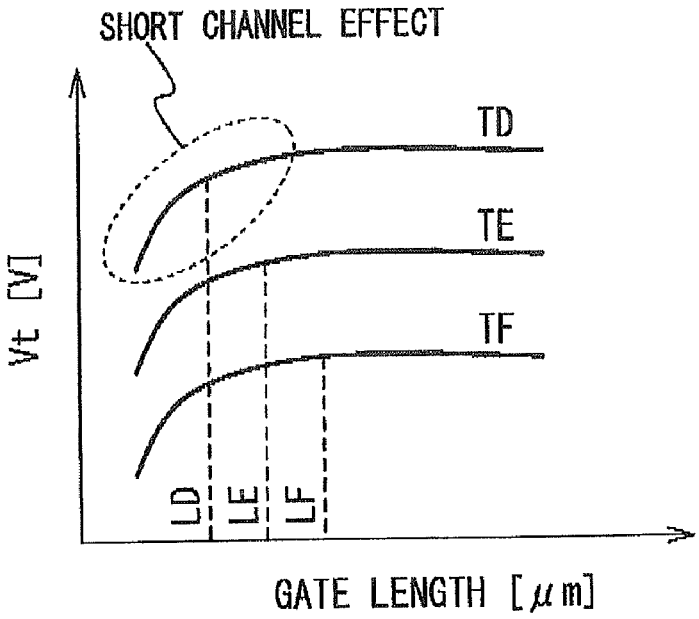
FIG. 11 is a graph showing a gate length and a threshold voltage of a MOS transistor.

FIG. 11 shows a relation between gate length L and threshold voltage Vt of the MOS transistor. If the gate length (channel length) is sufficiently long, the threshold voltage Vt is constant independently of the gate length L. However, it is known that, if the gate length is very short, the decrease in the gate length L consequently decreases the threshold voltage Vt. This phenomenon is referred to as [Short Channel Effect]. The decrease in the threshold voltage Vt causes a punch-through phenomenon, under which a current always flows between the source and the drain. Thus, the gate length L cannot be typically made extremely short.

On the other hand, as mentioned above, the maximum voltages with regard to the N-channel MOS transistors TD to TF, namely, substrate biases Vsub are different from each other, and "Bottom-Up" of the threshold voltages Vt due to the substrate bias effects are also different from each other. As shown in FIG. 11, the substrate bias effect is the greatest in the N-channel MOS transistor TD and the smallest in the N-channel MOS transistor TF. The threshold voltage Vt of the N-channel MOS transistor TD is relatively high. Thus, even if its gate length LD is shorter, the punch-through phenomenon is hard to occur. That is, it is possible to cancel the increase in the threshold voltage Vt caused by the substrate bias effect with the decrease in the threshold voltage Vt caused by the short channel effect.

According to this embodiment, the gate length LD of the N-channel MOS transistor TD is designed to be the shortest, and the gate length LF of the N-channel MOS transistor TF is designed to be the longest. The gate length LE of the N-channel MOS transistor TE is designed to be longer than the gate length LD and shorter than the gate length LF (refer to FIGS. 7 to 9). Consequently, the useless gate length L is removed, thereby making the size of each MOS transistor proper.

Figure 12:
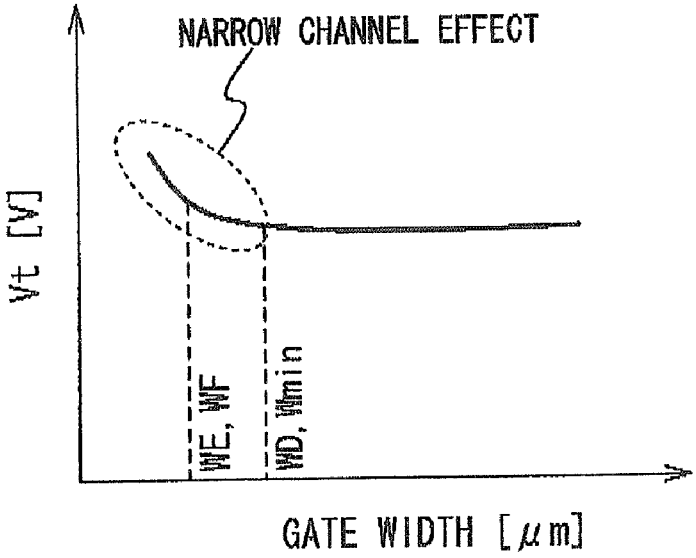
FIG. 12 is a graph showing a gate length and a threshold voltage of a MOS transistor.

FIG. 12 shows a relation between gate width W and threshold voltage Vt of the MOS transistor. As shown in FIG. 12, if the gate width (channel width) W is small, the decrease in the gate width W consequently increases the threshold voltage Vt. This phenomenon is referred to as [Narrow Channel Effect]. In the usual MOS transistor, the gate width W is designed such that the narrow channel effect does not appear (W=Wmin).

In this embodiment, the digital image data D0 to D5 applied to the gates of the respective N-channel MOS transistors have the voltages VDD of full amplitudes. Thus, the slight increase in the threshold voltage Vt is allowable on a circuit operation. In particular, since the increase in the threshold voltage Vt caused by the substrate bias effect is relatively small, the slight increase in the threshold voltage Vt is allowable. Thus, gate widths WE, WF of the N-channel MOS transistors TE, TF are designed to be smaller than the Wmin. In this case, the narrow channel effect appears in the N-channel MOS transistors TE, TF. The gate width WD of the N-channel MOS transistor TD is designed to be substantially equal to the Wmin. In this way, the useless gate width W is removed, thereby making the size of each MOS transistor suitable.

Figure 13:
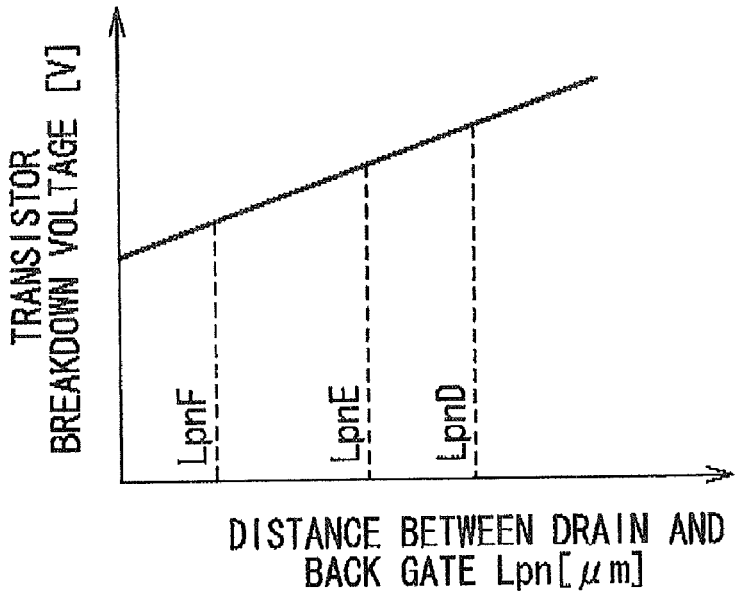
FIG. 13 is a graph showing a relation between a drain-back gate interval and a breakdown voltage of a MOS transistor.

Next, an interval (shortest length) Lpn between the $N^-$ type diffusion layer 104 of the low concentration and the back gate contact diffusion layer 108 will be described. FIG. 13 shows a relation between the interval Lpn and the transistor breakdown voltage (PN junction breakdown voltage). As understood from FIG. 13, there is a tendency that as the interval Lpn becomes longer, the transistor breakdown voltage becomes higher. Reversely speaking, if the high breakdown voltage is not required, the interval Lpn can be designed to be short. Under the low breakdown voltage condition, the spread of a depletion layer that extends from the N-type diffusion layer 104 into the P well 101 is short, thereby making the generation of a reach-through phenomenon (a phenomenon that the depletion layer reaches a high concentration layer and is broken down) difficult. Thus, the interval Lpn can be designed to be short.

According to this embodiment, an interval LpnF in the N-channel MOS transistor TF of the block BL-F is designed to be shorter than an interval LpnE in the N-channel MOS transistor TE of the block BL-E. Also, the interval LpnE in the N-channel MOS transistor TE of the block BL-E is designed to be shorter than an interval LpnD in the N-channel MOS transistor TD of the block BL-D. Consequently, the size of each MOS transistor is made suitable.

As described above, the structure (the offset length Lo, the gate length L, the gate width W and the interval Lp) of the MOS transistor according to this embodiment is optimized on the basis of the maximum voltage, the substrate bias effect, the threshold voltage and the like. Through this optimization, the sizes of the respective MOS transistor and the separation distance between them have the minimum dimensions. As a result, the area of the gradation voltage selecting circuit 12 is greatly reduced. Also, the size of the semiconductor chip is greatly reduced. Thus, the liquid crystal display driver can be provided at the lower cost.

Also, according to this embodiment, the voltage applied to the back gate is not required to be controlled for each block BL, in order to reduce the breakdown voltage of the MOS transistor. The same voltage VDD is uniformly applied to the back gates of the P-channel MOS transistors TA to TC on the positive side, and the same voltage VSS is uniformly applied to the back gates of the N-channel MOS transistors TD to TF on the negative side. The back gate voltage is not required to be controlled. Thus, when the gradation voltage selecting circuit 12 is manufactured, the special diffusing process is not required to be added. The present invention can be easily attained by making the present layout design suitable.

Second Embodiment

Figure 14:
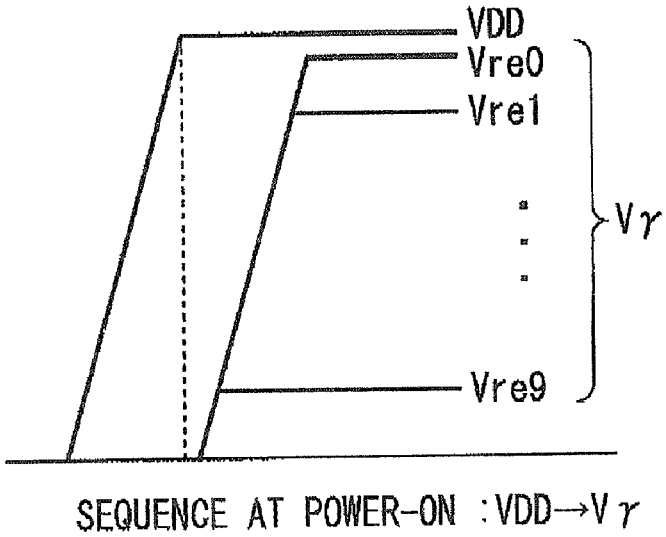
FIG. 14 is a conceptual view showing a start-up order of a power source.

FIG. 14 shows one example of a start-up sequence of the power source in the liquid crystal displaying apparatus. In this example, the reference voltage Vγ (Vref0 to Vref9) is generated after the start-up of the power source voltage VDD. In short, immediately after the start-up of the power source voltage VDD, the reference voltages Vγ are still zero. As already shown in FIG. 5, the power source voltage VDD is applied to the back gates of the P-channel MOS transistors TA to TC on the positive side. Thus, immediately after the start-up of the power source voltage VDD, the power source voltage VDD close to the full state is applied to the P-channel MOS transistor at the first stage that is directly connected to the gradation voltage generating circuit 11. However, the breakdown voltages of the P-channel MOS transistors TA to TC are VDD/2 or less. Hence, those P-channel MOS transistors are broken down, and the gradation voltage selecting circuit 12 is broken.

The second embodiment provides a technique that can avoid the foregoing problems even if the start-up sequence shown in FIG. 14 is employed.

Figure 15:
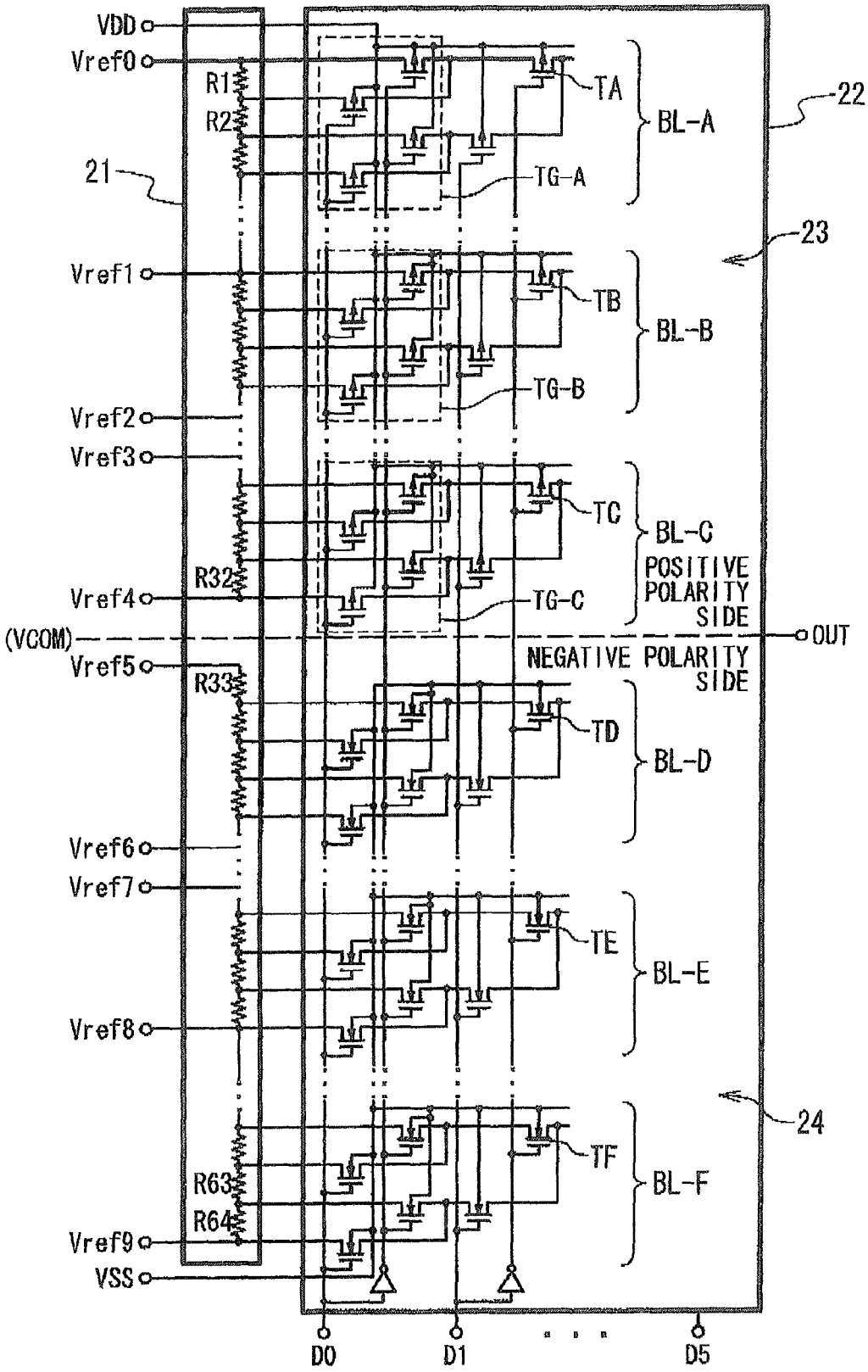
FIG. 15 is a circuit diagram showing a configuration of a gradation voltage determining according to a second embodiment.

FIG. 15 shows a circuit diagram showing the configuration of a gradation voltage determining circuit according to the second embodiment. The gradation voltage determining circuit has a gradation voltage generating circuit 21 and a gradation voltage selecting circuit 22. The configuration of the gradation voltage generating circuit 21 is similar to that of the gradation voltage generating circuit 11 in the first embodiment. The connection configuration of the MOS transistors in the gradation voltage selecting circuit 22 is also similar to that in the gradation voltage selecting circuit 12 in the first embodiment. Also, the gradation voltage selecting circuit 22 is classified into a plurality of selecting circuit blocks BL, similarly to the first embodiment. The blocks BL-A to BL-C constitute a positive side block group 23. The blocks BL-D to BL-F constitute the negative side block group 24.

The structures of the MOS transistors TA to TF included in the blocks BL-A to BL-F are basically same as the structures in the first embodiment, respectively. The power source voltage VDD is applied to the back gates of the P-channel MOS transistors TA to TC on the positive side, and the ground voltage VSS is applied to the back gates of the N-channel MOS transistors TD to TF on the negative side. However, according to this embodiment, among the P-channel MOS transistors TA to TC on the positive side, the structures of the P-channel MOS transistors at the first stage (hereafter, referred to as [Fist-Stage MOS Transistor]) connected to the gradation voltage generating circuit 21 are different from the others.

The block BL-A includes the P-channel MOS transistor TA and a first-stage MOS transistor group TG-A having a structure different from the transistor TA. The block BL-B includes the P-channel MOS transistor TB and a first-stage MOS transistor group TG-B having a structure different from the transistor TB. The block BL-C includes the P-channel MOS transistor TC and a first-stage MOS transistor group TG-C having a structure different from the transistor TC. Those first-stage MOS transistor groups TG-A to TG-C are said to constitute the blocks different from the others.

The source or drain of each transistor in the first-stage MOS transistor groups TG is connected to an input terminal to which the corresponding gradation voltage is supplied. Immediately after the start-up of the power source voltage VDD, the reference voltages Vγ, namely, the gradation voltages V0 to V63 are zero. Thus, immediately after the start-up of the power source voltage VDD, the power source voltage VDD is applied to the back gate of the first-stage MOS transistor TG, and the source or drain thereof becomes in the state that approximately 0 V is applied.

Figure 16:
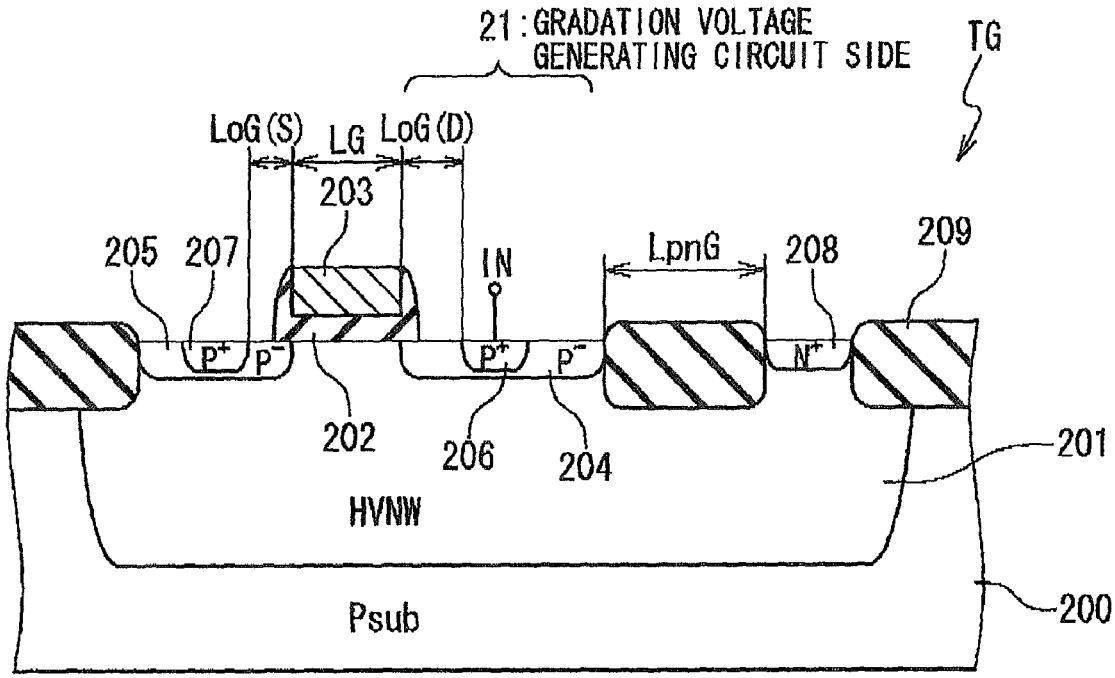
FIG. 16 is a sectional view showing a structure of a first stage MOS transistor in the second embodiment.

FIG. 16 shows a sectional structure of the first-stage MOS transistor TG according to this embodiment. A high voltage N well 201 is formed on the main surface side of a P-type semiconductor substrate 200. A gate electrode 203 is formed through a high voltage gate oxide film 202 on the surface of the high voltage N well 201. Also, a $P^-$ type drain diffusion layer 204 and a $P^-$ type diffusion layer 205 of a low concentration are formed inside the high voltage N well 201. Also, a $P^+$ type drain diffusion layer 206 as a drain is formed inside the $P^-$ type drain diffusion layer 204. A $P^+$ type source diffusion layer 207 as a source is formed inside the $P^-$ type diffusion layer 205. Also, a back gate contact diffusion layer 208 is formed inside the high voltage N well 201 to apply the back gate voltage to the high voltage N well 201. An element separation structure 209 is formed in an outer circumference region of the P-type diffusion layers 204, 205 and a back gate contact diffusion layer 208 to separate the respective P-channel MOS transistors and the back gate contact diffusion layer 208.

In FIG. 16, an input terminal IN of the gradation voltage selecting circuit 22 to which the gradation voltage is supplied is connected to the $P^+$ type drain diffusion layer 206. An offset length on the side of the $P^+$ type drain diffusion layer 206 is referred to as LoG(D). On the other hand, an offset length on the side of the $P^+$ type source diffusion layer 207 is referred to as LoG(S). As mentioned above, the high voltage is applied to the $P^+$ type drain diffusion layer 206 on the side of the input terminal IN, when the power source is started up. For this reason, according to this embodiment, the offset length LoG (D) is designed to be longer than the offset length LoG(S). As a result, only a portion connected to the gradation voltage generating circuit 21 has "High Breakdown Voltage Structure". Therefore, the breakdown when the power source is started up is protected.

With regard to the offset length LoG(S) on the side opposite to the input terminal IN, it may be designed to be equal to the offset length Lo of the other P-channel MOS transistor included in the same block BL. In short, the offset length LoG(S) of the first-stage MOS transistor TG-A may be equal to the offset length of the P-channel MOS transistor TA. The offset length LoG(S) of the first-stage. MOS transistor TG-B may be equal to the offset length of the P-channel MOS transistor TB. The offset length LoG(S) of the first-stage MOS transistor TG-C may be equal to the offset length of the P-channel MOS transistor TC. Consequently, the sizes of the transistors are reduced.

The structure of the MOS transistor according to this embodiment is basically similar to the first embodiment and optimized on the basis of the maximum voltage, the substrate bias effect, the threshold voltage and the like. Thus, the effect similar to the first embodiment is obtained. However, only a portion connected to the gradation voltage generating circuit 21 in the P-channel transistor group on the positive side is returned to the usual "High Breakdown Voltage Structure". Consequently, even if the start-up order shown in FIG. 14 is employed, the additional effect of protecting the breakdown of the gradation voltage selecting circuit 22 is obtained.

According to the present invention, the area of the voltage selecting circuit is greatly decreased, and the size of a semiconductor chip is also greatly decreased. Thus, the cost is reduced. Also, the special manufacturing process is not required. Therefore, the present invention can be easily attained by making the present layout design suitable.

What is claimed is:

1. A liquid crystal display driver comprising:

a first selecting circuit configured to select a voltage from a first voltage range based on a digital signal; and a second selecting circuit configured to select a voltage from a second voltage range based on said digital signal, wherein a voltage which is applied between a diffusion layer and a back gate of a first MOS transistor contained in said first selecting circuit is smaller than a voltage which is applied between a diffusion layer and a back gate of a second MOS transistor contained in said second selecting circuit, and an offset length of said first MOS transistor is shorter than that of said second MOS transistor.

2. The liquid crystal display driver according to claim 1, further comprising:

a voltage generating circuit configured to supply gradation voltages of said first voltage range and said second voltage range to said first and second selecting circuits, wherein one of said first and second selecting circuits outputs one of the gradation voltages based on said digital signal.

3. The liquid crystal display driver according to claim 1, wherein a same voltage is applied to said back gate of said first MOS transistor and said back gate of said second MOS transistor, and a difference between said first voltage range and between said same voltage is smaller than a difference between said second voltage range and said same voltage.

4. The liquid crystal display driver according to claim 1, wherein a gate length of said second MOS transistor is shorter than that of said first MOS transistor.

5. The liquid crystal display driver according to claim 1, wherein a gate width of said first MOS transistor is smaller than that of said second MOS transistor.

6. The liquid crystal display driver according to claim 1, wherein each of said first MOS transistor and said second MOS transistor comprises:

a low concentration diffusion layer for a drift region; and a contact diffusion layer used to apply a fixed voltage to said back gate, and the shortest distance between said low concentration diffusion layer and said contact diffusion layer in said first MOS transistor is shorter than the shortest distance between said low concentration diffusion layer and said contact diffusion layer in said second MOS transistor.

7. The liquid crystal display driver according to claim 1, wherein a power supply voltage is applied to said back gate of said first MOS transistor and said back gate of said second MOS transistor, the voltage of said first voltage range is smaller than said power supply voltage, and the voltage of said second voltage range is smaller than the voltage of said first voltage range.

8. The liquid crystal display driver according to claim 7, wherein each of said first selecting circuit and said second selecting circuit comprises:

a terminal to which a corresponding one of said first voltage range and said second voltage range is supplied; and a first stage MOS transistor having one of its source/drain connected with said terminal, said power supply voltage is applied to the back gate of said first stage MOS transistor, and the offset length of one of the source and the drain which is connected with said terminal is longer than that of the other source and drain not connected with said terminal, in said first stage MOS transistor.

9. The liquid crystal display driver according to claim 8, wherein the offset length of the other source and drain not connected with said terminal is equal to said offset length of said first MOS transistor and said offset length of said second MOS transistor, respectively.

10. A liquid crystal display driver comprising:

a first selecting circuit configured to select a voltage from a first voltage range based on a digital signal; and a second selecting circuit configured to select a voltage from a second voltage range based on said digital signal, wherein a voltage which is applied between a diffusion layer and a back gate of a first MOS transistor in said first selecting circuit is smaller than a voltage which is applied between a diffusion layer and a back gate of a second MOS transistor in said second selecting circuit, and a gate width of said first MOS transistor is smaller than a gate width of said second MOS transistor.

11. The liquid crystal display driver according to claim 10, further comprising:

a voltage generating circuit configured to supply gradation voltages of said first voltage range and said second voltage range to said first and second selecting circuits, wherein one of said first and second selecting circuits outputs one of the gradation voltages based on said digital signal.

12. The liquid crystal display driver according to claim 10, wherein in said first MOS transistor, a narrow channel effect appears.

13. A liquid crystal display driver comprising:

a first selecting circuit configured to select a voltage from a first voltage range based on a digital signal; and a second selecting circuit configured to select a voltage from a second voltage range based on said digital signal, wherein a voltage which is applied between a diffusion layer and a back gate of the first MOS transistor in said first selecting circuit is smaller than a voltage which is applied between a diffusion layer and a back gate of a second MOS transistor in said second selecting circuit, each of said first MOS transistor and said second MOS transistor comprises:

a low concentration diffusion layer for a drift region; and a contact diffusion layer configured to apply a fixed voltage to said back gate, and the shortest distance between said low concentration diffusion layer and said contact diffusion layer in said first MOS transistor is shorter than the shortest distance between said low concentration diffusion layer and said contact diffusion layer in said second MOS transistor.

14. The liquid crystal display driver according to claim 13, further comprising:

a voltage generating circuit configured to supply gradation voltages of said first voltage range and said second voltage range to said first and second selecting circuits, wherein one of said first and second selecting circuits outputs one of the gradation voltages based on said digital signal.

15. The liquid crystal display driver according to claim 13, further comprising:

a third selecting circuit configured to select a voltage from a third voltage range based on said digital signal; and a fourth selecting circuit configured to select a voltage from a fourth voltage range based on said digital signal, wherein a voltage which is applied between a diffusion layer and a back gate of a third MOS transistor in said third selecting circuit is smaller than a voltage which is applied between a diffusion layer and a back gate of a fourth MOS transistor in said fourth selecting circuit, and an offset length of said third MOS transistor is shorter than that of said fourth MOS transistor.

16. The liquid crystal display driver according to claim 15, wherein said first MOS transistor and said second MOS transistor are P-channel MOS transistors, and said third MOS transistor and said fourth MOS transistor are N-channel MOS transistors.

17. The liquid crystal display driver according to claim 16, wherein the voltage of said first voltage range and the voltage of said second voltage range are larger than a predetermined common voltage, and the voltage of said third voltage range and the voltage of said fourth voltage range are smaller than said predetermined common voltage.

18. A liquid crystal display apparatus comprising:

a liquid crystal display driver; and a liquid crystal display panel which has a plurality of pixels, wherein said liquid crystal display driver comprises:

a first selecting circuit configured to select a voltage from a first voltage range based on a digital signal;

a second selecting circuit configured to select a voltage from a second voltage range based on said digital signal; and a voltage generating circuit configured to supply gradation voltages of said first voltage range and said second voltage range to said first and second selecting circuits, one of said first and second selecting circuits outputs one of the gradation voltages based on said digital signal, said liquid crystal display driver applies the gradation voltage to either of said plurality of pixels, a voltage which is applied between a diffusion layer and a back gate of a first MOS transistor contained in said first selecting circuit is smaller than a voltage which is applied between a diffusion layer and a back gate of a second MOS transistor contained in said second selecting circuit, and an offset length of said first MOS transistor is shorter than that of said second MOS transistor.

* * * * *